US009622527B2

(12) United States Patent
Nguyen

(10) Patent No.: US 9,622,527 B2
(45) Date of Patent: Apr. 18, 2017

(54) SINGLE SECTION LIFT-UP TECHNIQUE FOR EYELASH EXTENSIONS

(71) Applicant: Quyen Nguyen, Beltsville, MD (US)

(72) Inventor: Quyen Nguyen, Beltsville, MD (US)

( * ) Notice: Subject to any disclaimer, the term of this patent is extended or adjusted under 35 U.S.C. 154(b) by 0 days.

(21) Appl. No.: 14/507,436

(22) Filed: Oct. 6, 2014

(65) Prior Publication Data

US 2016/0095374 A1 Apr. 7, 2016

(51) Int. Cl.
*A41G 5/02* (2006.01)

(52) U.S. Cl.
CPC ..... *A41G 5/02* (2013.01)

(58) Field of Classification Search
CPC ..... A41G 5/02; A45D 40/30
USPC ..... 132/200, 201, 216, 53
See application file for complete search history.

(56) References Cited

U.S. PATENT DOCUMENTS

| | | | | |
|---|---|---|---|---|
| 3,833,007 | A | 9/1974 | Jacobs | |
| 4,299,242 | A | 11/1981 | Choe | |
| 5,547,529 | A | 8/1996 | Woolf | |
| 9,179,723 | B1 * | 11/2015 | Yoo | A45D 40/30 |
| 2005/0061341 | A1 | 3/2005 | Choe | |
| 2007/0023062 | A1 * | 2/2007 | McKinstry | A41G 5/02 132/201 |
| 2007/0050207 | A1 * | 3/2007 | Merszei | A41G 5/02 705/2 |
| 2007/0227550 | A1 | 10/2007 | Merszei | |
| 2007/0272264 | A1 | 11/2007 | Byrne | |
| 2007/0295352 | A1 * | 12/2007 | Dinh | A41G 5/02 132/200 |
| 2007/0295353 | A1 * | 12/2007 | Dinh | A41G 5/02 132/216 |
| 2009/0235950 | A1 | 9/2009 | Dinh | |
| 2009/0266376 | A1 * | 10/2009 | Beschta | A41G 5/02 132/201 |
| 2010/0170526 | A1 * | 7/2010 | Nguyen | A41G 5/02 132/201 |
| 2012/0055499 | A1 * | 3/2012 | Sanbonmatsu | A41G 5/02 132/201 |
| 2012/0145173 | A1 * | 6/2012 | Dinh | A41G 5/02 132/200 |

(Continued)

FOREIGN PATENT DOCUMENTS

KR 101381054 B1 * 4/2014

OTHER PUBLICATIONS

Trevor Born, TMB ROad Reip! Eyelasj Extensions at Avenure Akin Care . . . , http://www.tmbcosmeticsurgery.com/tmb-truly-modern-blog/tmb-road-trip-eyelash-extensions-at-avenue-skin-care/, May 31, 2013.*

(Continued)

*Primary Examiner* — Tatiana Nobrega
(74) *Attorney, Agent, or Firm* — Thien Tran, Esq; Access Patent Group, LLC

(57) ABSTRACT

A single section lift-up technique for eyelash extensions with curved tweezers. Place three pieces of surgical tape over upper natural eyelashes to divide the eyelid into an outer corner, a middle and an inner corner section. Lift up the upper eyelashes one at a time from under the surgical tape on each section with a curved tweezers. Attach adhesive coated false eyelashes one at a time against the upper lashes of the each section with the curved tweezers. Attach adhesive coded false eyelashes one at a time against the upper eyelashes of each section with the curved tweezers.

7 Claims, 8 Drawing Sheets

(56) References Cited

U.S. PATENT DOCUMENTS

| | | | | |
|---|---|---|---|---|
| 2014/0069450 | A1* | 3/2014 | Le | A41G 5/02 132/201 |
| 2015/0114421 | A1* | 4/2015 | Pham | A41G 5/02 132/201 |
| 2015/0128986 | A1* | 5/2015 | Stookey | A41G 5/02 132/216 |
| 2016/0058088 | A1* | 3/2016 | Le | A41G 5/02 132/201 |

OTHER PUBLICATIONS

Eyelash Extensions Video by OutLashe, https://www.youtube.com/watch?v=JIWRxQxL3O8, Aug. 10, 2009 and Still images captured from Eyelash Extension video by OutLashe.*

* cited by examiner

SINGLE SECTION LIFT-UP TECHNIQUE FOR EYELASH EXTENSIONS

CROSS-REFERENCE TO RELATED APPLICATION

This application claims the benefit of Provisional Patent Application No. 61/988,295, filed on May 4, 2014, in the United States Patent & Trademark Office, the disclosure of which is incorporated herein by reference.

BACKGROUND OF THE INVENTION

Field of the Invention

The present invention relates to false eyelashes and more particularly, a single section lift-up technique for eyelash extensions.

Individual eyelash extensions have been around for years. Many professional eyelash techs indicate that the individual single eyelash application takes a long time and is very straining to the eyes. Professionals have a hard time separating each individual natural eyelash and isolate it. Using two tweezers one in each hand is hard for some to do knowing that some people can't use both hands at the same time.

Eyelash extensions are any number of enhancements designed to add length, thickness and fullness to natural eyelashes. They may be compared to hair extensions for one's eyelashes. They can be separated into two types: temporary and semi-permanent. The use of false eyelashes began in 1916 when director D. W. Griffith was making his film Intolerance. He wanted actress Seena Owen to have eyelashes "that brushed her cheeks, to make her eyes shine larger than life." The first false eyelashes were made of human hair woven through fine gauze by a local wig maker. They were then attached to Owen's eyes.

Temporary false eyelashes are any eyelashes designed to be worn for a short period, such as a day or less. They can be made with human hair, or with synthetic materials. They are not designed to be worn when showering, sleeping or swimming. They are applied with eyelash glue designed specifically for temporary eyelashes. Permanent eyelashes, also known as eyelash extensions, are false eyelashes applied with a stronger adhesive. Generally, a single false eyelash is applied to each natural lash. When applied properly, neither the extension false eyelash nor the glue should touch the eyelid. However, slight irritation and watering of the eye may occur if the glue does come into contact with the eye. The bond is designed to last until the eyelashes naturally fall out, though the extensions may fall out faster if one uses oil-based eye makeup remover or rubs the eyes regularly, as oil weakens the bond between the glue and the eyelash. For both types, eyelashes come in various lengths, colors and thicknesses, from natural-looking to outrageous. The two most popular styles are doll eyelashes, consisting of longer lashes at the center of the eyelash line, and cat-eye eyelashes, where the end of the eyelashes are longer to create a cat-like eye.

A set of new eyelash extensions can vary in price, depending on the type and number of false eyelashes used, the skill of the cosmetician and the venue where extensions are performed. It usually takes an hour to two hours to attach a full new set. An average person might have anywhere from thirty to eighty eyelashes per eye. The variance in the number of false eyelashes accounts for the difference in how long it takes to apply them.

Many eyelash extension packages come with repair options, where one can go get the fallen extensions added within a few weeks from the initial application, at a lowered cost.

Description of the Prior Arts

Numerous innovations for artificial eyelashes have been provided in the prior art that will be described. Even though these innovations may be suitable for the specific individual purposes to which they address, however, they differ from the present invention.

A FIRST EXAMPLE, U.S. Pat. No. 3,833,007, Issued on Sep. 3, 1974, to Jacobs teaches a method and articles for applying artificial eyelashes to a human subject, such articles consisting of a plurality of single, but feathered lashes, each single feathered lash extending several lash ends having one group fold secured together as by crimping, adhesion or tying, and a latex-base liquid surgical-type adhesive for securing the single feathered lashes to the subject's already-existing natural lashes in a semi-permanent, long-lasting secure fastening. The method consists of applying the adhesive to the single feathered eyelashes and placing the single feathered eyelash on the upper side, lower side or between the subject's already-existing eyelashes, thus extending the length of the natural lash. This procedure utilizing the article may be applied to either or both of the subject's upper and lower natural lashes.

A SECOND EXAMPLE, U.S. Pat. No. 4,299,242, issued on Nov. 10, 1981, to Choe teaches a method of making artificial strip and cluster eyelashes. The method includes the steps of knotting eyelash strands to a support. While still being supported, the strands are heated and bonded together along a line parallel to and adjacent the knots. After heating and bonding, the lash strands are severed from the knots along a line intermediate the knots and the heating and bonding line.

A THIRD EXAMPLE, U.S. Pat. No. 5,547,529, issued on Aug. 20, 1996, to Woolf teaches a false eyelash system, for producing unknotted clusters of false eyelashes from long fibers. A plurality of long fibers are knotted around a main string with a preliminary knot. The long fibers are trimmed a distance away from the main string that corresponds to a desired eyelash length. Cement is applied to the preliminary knot and discernible distance therefrom to form a cement clot. The preliminary knot is removed by cutting through the cement clot to form unknotted clusters of false eyelashes.

A FOURTH EXAMPLE, U.S. Patent Office Publication No. 2005/0061341, published on Mar. 24, 2005, to Choe teaches false eyelashes for attachment to the edge of an eyelid. The false eyelashes include a plurality of lashes arranged in a curved state; and an attachment section formed by applying an adhesive to one end of the lashes, the attachment section being formed such that the lashes are not knotted together at the attachment section. A plurality of the false eyelashes are applied to the edge of an eyelid of each eye.

A FIFTH EXAMPLE, U.S. Patent Office Publication No. 2007/0023062, published on Feb. 1, 2007, to McKinstry et al. teaches a method for applying eye lashes using artificial eyelashes which includes the steps of: providing an object of having upper eye lashes and lower eye lashes; providing a set of artificial eyelashes having a predetermined length; applying an attaching element onto a portion of the at least one of the artificial eyelashes; and connecting the portion of one of the artificial eyelashes with one of the upper eye lashes such that a gap exist between the artificial eyelashes along the one of the upper eye lashes between a tip of the port and upper eyelid.

A SIXTH EXAMPLE, U.S. Patent Office Publication No. 2007/0272264, published on Nov. 29, 2007, to Byrne teaches an eyelid that has a natural lash line containing natural eyelashes. An eyelash adornment apparatus for the eyelid includes a plurality of lash subassemblies. Each lash subassembly includes an elongated mounting portion and a plurality of elongated lash filaments. Each lash filament has a filament base and an oppositely disposed filament tip. The filament base is attached to the mounting portion with the filament tip extending from the mounting portion. The lash subassemblies are each adapted for affixation to the eyelid. A chosen one of the lash subassemblies, when affixed to the eyelid, is operative to provide at least one of a different visual impression than a visual impression provided by another one of the lash subassemblies when affixed to the eyelid, and a different visual effect upon the natural eyelashes than a visual effect provided by the other one of the lash subassemblies when affixed to the eyelid. A method of adorning an eyelash of a wearer is also provided.

A SEVENTH EXAMPLE, U.S. Patent Office Publication No. 2007/0295353, published on Dec. 27, 2007, to Dib teaches eyelash extensions and a method for applying the same. The eyelash extensions comprise a first filament having both a proximal end and a distal portion with a distal end. Each of the proximal end and distal end are tapered and of a size such that the proximal end can be attached with a single eyelash. In some aspects, the filament can be branched to form a branched eyelash extension. The eyelash extensions come in multiple sizes, shapes, and colors to provide the user with increased aesthetics and comfort.

It is apparent now that numerous innovations for artificial eyelashes have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a single section lift-up technique for eyelash extensions that avoids the disadvantages of the prior art.

ANOTHER OBJECT of the present invention is to provide a single section lift-up technique for eyelash extensions that is simple and inexpensive to manufacture.

STILL ANOTHER OBJECT of the present invention is to provide a single section lift-up technique for eyelash extensions that is simple to use.

BRIEFLY STATED, STILL YET ANOTHER OBJECT of the present invention is to provide a single section lift-up technique for eyelash extensions. Cover lower eyelashes with a gel pad. Apply two tape to cover the lower lashes that the gel pad didn't get. Put two pieces of surgical tape (or sticky tape) onto an upper eyelid to keep it stationary. Place three pieces of surgical tape over upper eyelashes to divide them into an outer corner, a middle and an inner corner section. Then, lift up the upper eyelashes one at a time from under the surgical tape on the outer corner section with a curved tweezers. Attach adhesive coded false eyelashes one at a time against the upper lashes of the outer corner section with the curved tweezers. Tape up the pre-done eyelashes of the outer corner section. Lift up the upper eyelashes one at a time from under the tape on the middle section with the curved tweezers. Attach adhesive coded false eyelashes one at a time against the upper eyelashes of the middle section with the curved tweezers. Tape up the pre-done eyelashes of the middle section. Lift up the upper eyelashes one at a time from under the surgical tape on the inner corner section with the curved tweezers. Attach adhesive coded false eyelashes one at a time against the upper eyelashes of the inner corner section with the curved tweezers. Tape up the pre-done eyelashes of the inner corner section.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

REFERENCE NUMERALS UTILIZED IN THE DRAWING

Figure 1:
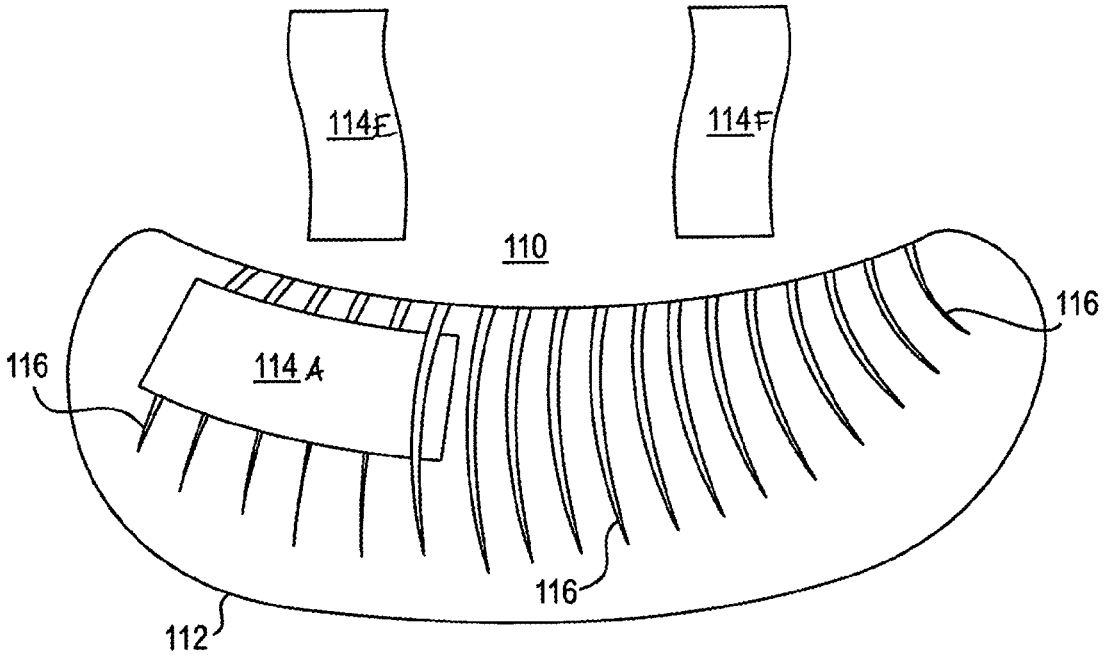
FIG. 1 is a schematic top view showing an eye with a gel pad in place and a first piece of surgical tape applied to a first outer section of the natural eyelashes.
Figure 2:
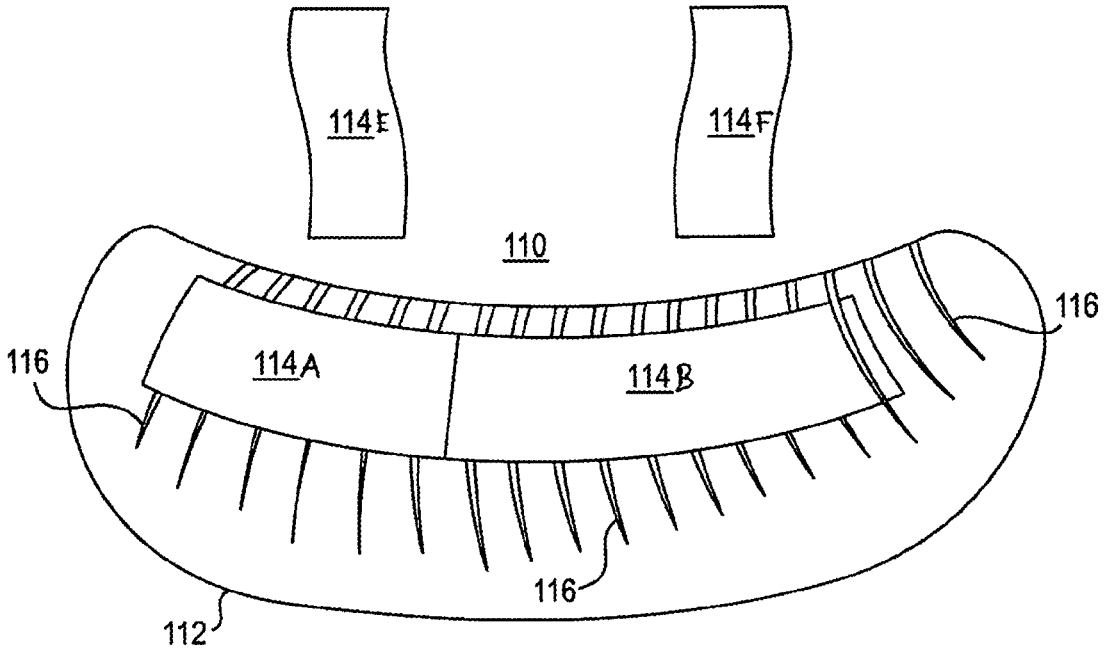
FIG. 2 is a schematic top view showing the eye with the gel pad in place and a second piece of surgical tape applied to a second middle section of the natural eyelashes.
Figure 3:
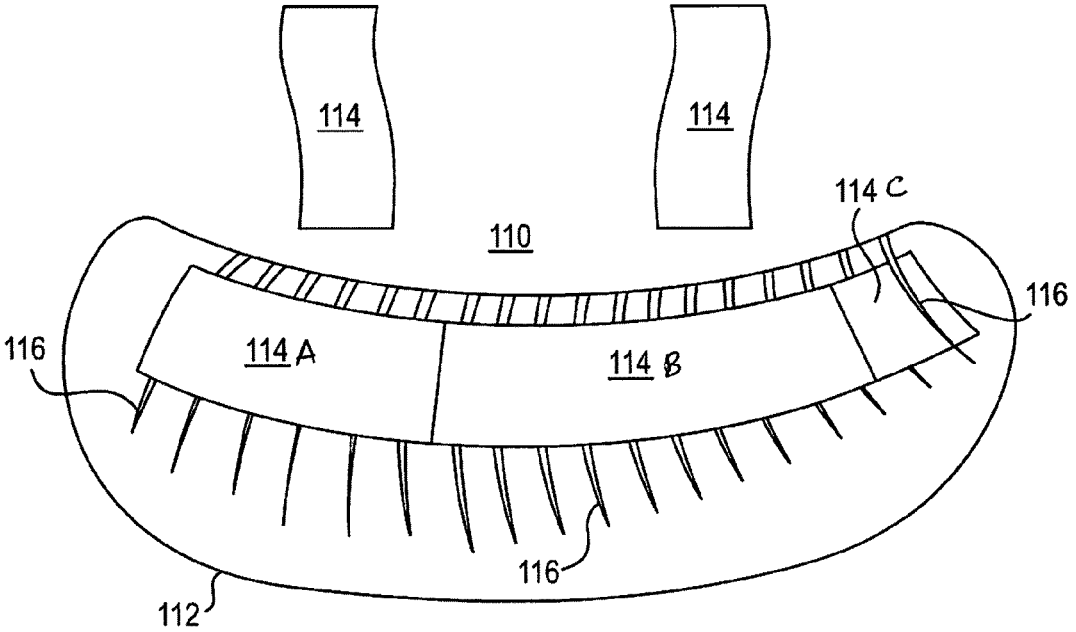
FIG. 3 is a schematic top view showing the eye with the gel pad in place and a third piece of surgical tape applied to a third inner section of the natural eyelashes.
Figure 4:
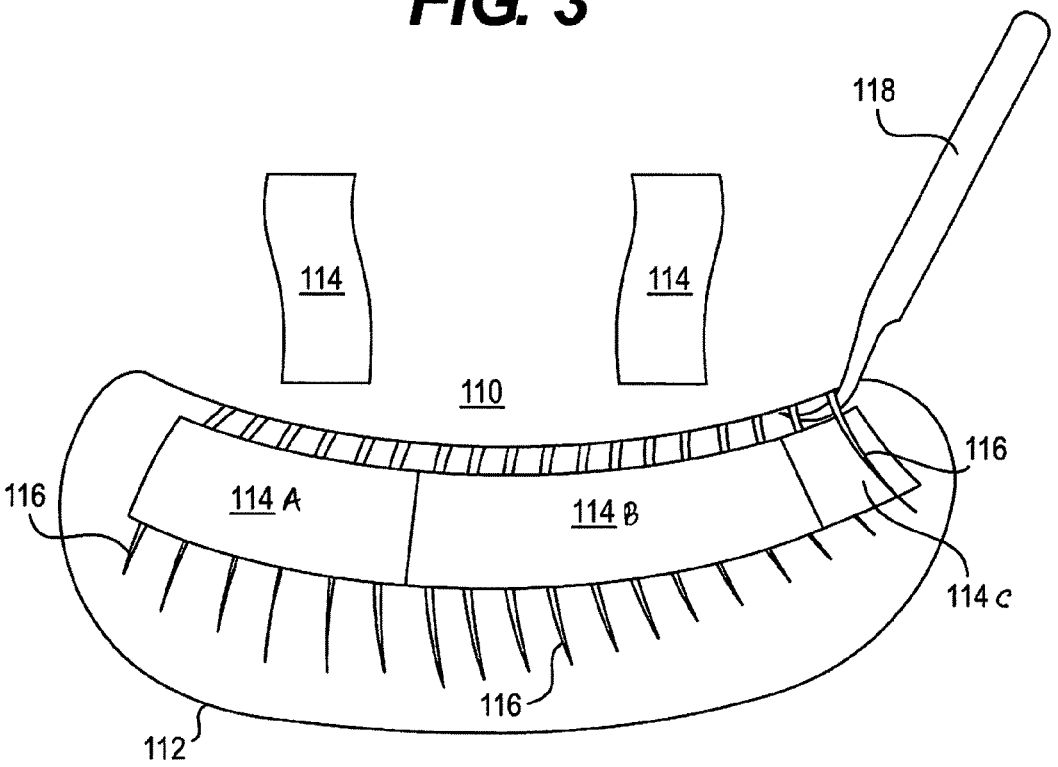
FIG. 4 is a schematic top view showing a curved tweezers used to lift-up a first natural eyelash strand, and then a second natural eyelash strand in the third inner section.
Figure 5B:
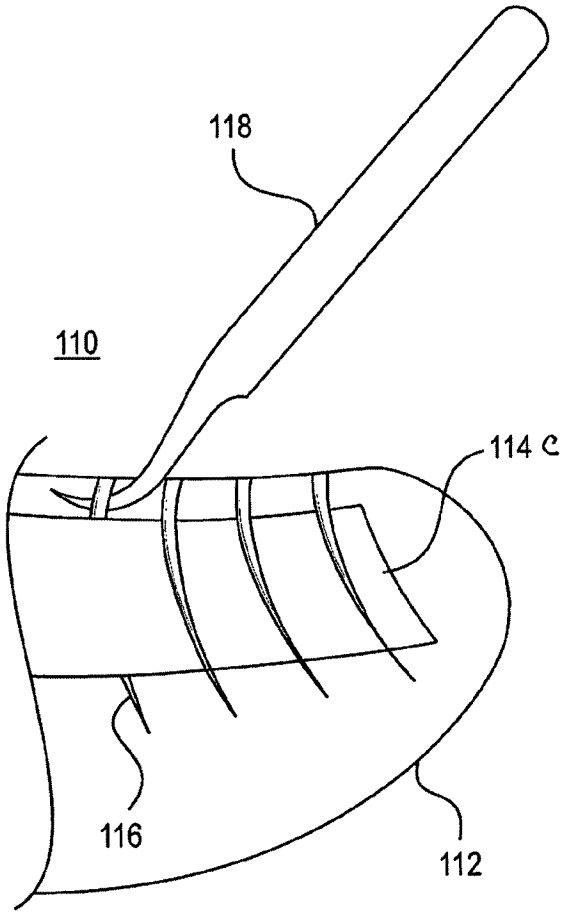
FIG. 5B is a schematic top view showing the curved tweezers used to lift-up a fourth natural eyelash strand in the third inner section.
Figure 5A:
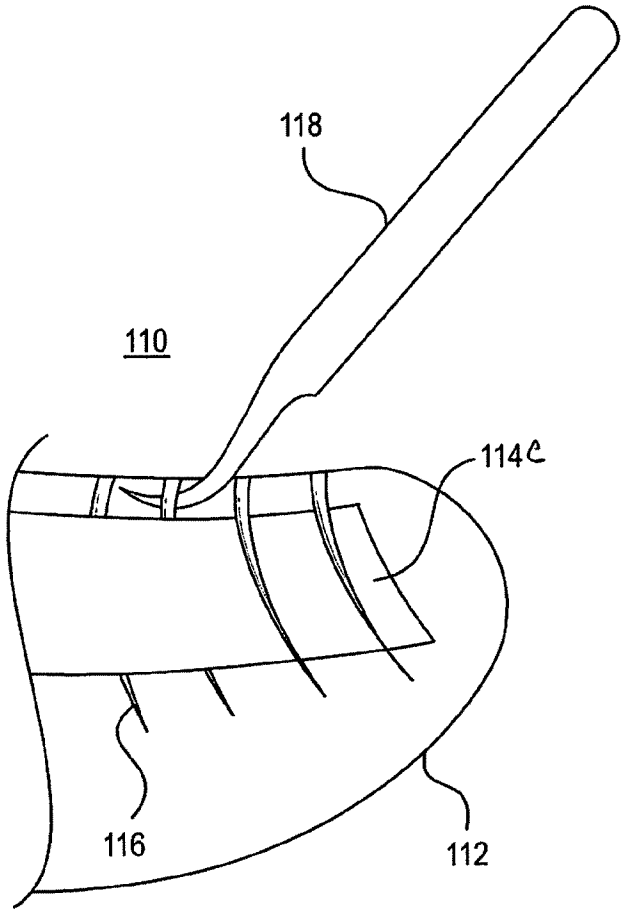
FIG. 5A is a schematic top view showing the curved tweezers used to lift-up a third natural eyelash strand in the third inner section.
Figure 6:
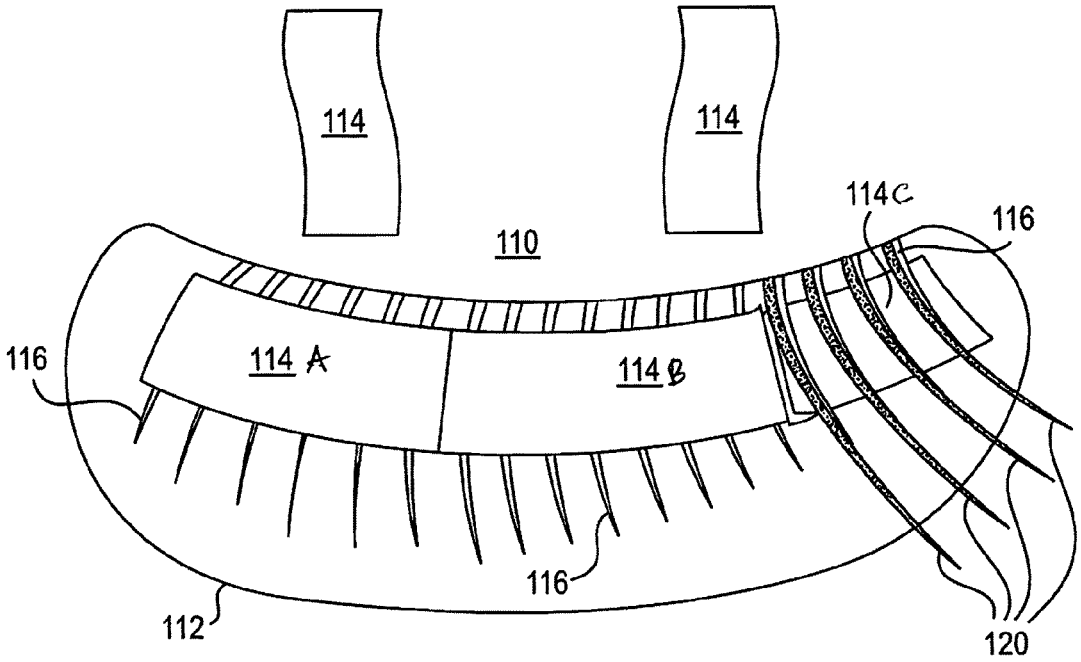
FIG. 6 is a schematic top view showing the attachment of first, second, third, and fourth artificial eyelashes to the first, second, third, and fourth lifted-up natural eyelash strands in the third inner section.

110 eyelid
112 gel pad

114 surgical tape
116 upper natural eyelash
118 curved tweezers
120 false eyelash

DETAILED DESCRIPTION OF THE PREFERRED EMBODIMENT

Before using the single section lift-up technique for eyelash extensions identify the eye shape of the client. By knowing the eye shape of the client it will help in choosing the look of the eyelash extensions. There is an open look being a short eyelash length in section one, a long eyelash length in section two, and a short eyelash length in section three. For an elongated look section one has a short eyelash length, section two long lash length, and section three a long eyelash length. Section one is called the inner section, section two is called the middle section (largest section), while section three is called the outer section.

Now choose the size for the client in which the individual false eyelash can range from 6 mm to 16 mm in length and 0.10 mm to 0.35 mm in diameter.

The individual false eyelashes can also be in many different curl shapes, such as a J-shaped natural curl, a D-shaped curl which is curlier than the J-shape curl, a C-shape curl which is curlier than both the J-shaped and D-shaped curls, and a B-shaped curl which is curlier than the J-shaped, D-shaped and C-shaped curls.

The individual false eyelashes can be made out of silk fibers or faux mink fibers compressed and shaped to replicate a natural eyelash. The use of the silk fibers and the faux mink fibers allows the individual false eyelashes to be porous allowing adhesive to strongly bond to the individual false eyelashes and the real natural eyelashes.

Cleanse the clients' eyelid and upper natural eyelashes. Pull the eyelid up, and invert the base of the upper natural eyelashes to be exposed, where all the makeup and oil is imbedded. With a wet compress cleanse the base of the upper natural eyelashes by moving in a downward motion. Start from the outer corner moving inward to the tear duct using the wet compress to cleanse the lower natural eyelashes. Removing all natural oils, makeup, and residue will help extend the life of the application.

In FIG. 1—for right eye: With the clients' eyelid 110 in a closed position: lift the upper eyelid 110. Apply a gel pad 112 to cover the lower natural eyelashes. If needed, pieces of surgical tape 114 can be applied over the gel pad 112 to cover the lower natural eyelashes (not shown) that the gel pad 112 missed. The reason for taping down the lower natural eyelashes when the eyelid 110 is in a closed position is because when the clients' eyelid 110 is opened and then closed the lower eyelid muscles will move causing the lower natural eyelashes to shift.

Two reasons for taping down the lower natural eyelashes. The first reason is to prevent the upper natural eyelashes 116 and bottom natural eyelashes from sticking together during the application. The second reason is to help separate which are the upper natural eyelashes 116 and which are the lower natural eyelashes during the application. Make sure the surgical tape 114 (A, B, C, D, E, F) and gel pad 112 are not to close to the waterline of the eyes. By doing so you can accidently scratch the cornea of the customer. Also the surgical tape 114A-114F should be flat and smooth.

As shown in FIGS. 1 through 13 extend the natural eyelashes 116 with surgical tape 114A-114C by holding up the clients' eyelid 110 slightly. Tape the eyelid 110 up by placing a first piece of surgical tape 114C on the inner corner of the eyelid 110, and a second piece of surgical tape 114A on the outer corner of the eyelid 110.

There are two reasons that a curved tweezers 118 is helpful with in the single section lift-up technique. The first reason is an isolating procedure using the curved tweezers 118. In using the curved tweezers 118 isolate a single natural eyelash 116. Whichever natural eyelash 116 is to be isolated, close the curved tweezers 118 by slightly putting the natural eyelash 116 between the tips of the curved tweezers 118. Once the curved tweezers 118 is put where needed release its spring, so that the curved tweezers 118 will open up, spreading the natural eyelashes 116 away from the isolated natural eyelash 116. The second reason is a picking procedure using the curved tweezers 118. The curved tweezers 118 is used to pick and pull natural eyelashes 116 from underneath the surgical tape 114A-114C, section by section, starting at one end and going to the other end.

Now, section off the natural eyelashes 116 of the upper eyelid 110. Tape the eyelid 110 up by using a piece of surgical tape 114C at the inner corner and a second piece of surgical tape 114A at the outer corner. By doing so it will help spread the natural eyelashes 116, and also allow for seeing the base of the natural eyelashes 116 better. On the eyelid 110 use a first piece of surgical tape 114 to cover the natural eyelashes 116 at the outer corner. Take a second piece of surgical tape 114B to cover the upper natural eyelashes 116 at the middle. Use a third piece of surgical tape 114C will to cover the inner corner of the eye. This will create three sections, being section one (inner corner 114C), section two (middle 114B), sections three (outer corner 114A). Then the different false eyelashes 120 will be assigned to each section. Alternating lengths in the different sections will give more dimension to the eyelashes, such as the open look or the elongated look.

As shown in FIG. 1 through FIG. 6, work on section one of the application. With the curved tweezers 118 pick out some natural eyelashes 116 from underneath the surgical tape 114C from section one (inner corner), the same way you would pick the hair out of a frosting cap to bleach. The natural eyelashes 116 that are pulled out from under the surgical tape 114C will be exposed. Take a false individual eyelash 120 and glide it through eyelash adhesive. Then stroke the natural eyelash 116 attaching the false eyelash 120 on top or on the side of the natural eyelash 120. Then, pick out some more natural eyelashes 116 in section one. Once section one is done, remove the surgical tape 114C from the inner corner.

Figure 7:
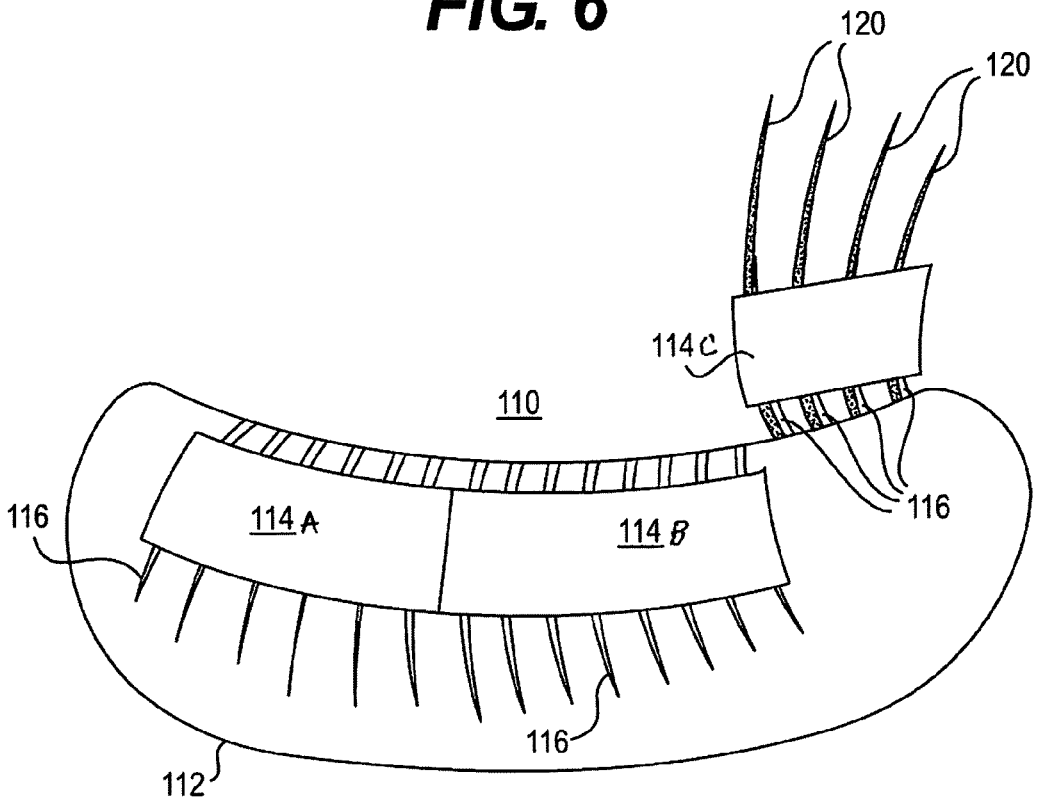
FIG. 7 is a schematic top view showing the taping up of pre-done eyelashes in the third inner section.

As shown in FIG. 7, also peel the surgical tape 114C from the first section, and tape the pre-done eyelashes upward. By doing so the surgical tape 114C actually lifts the base of the natural eyelashes 116 giving a more dramatic curl. Allow the adhesive to dry and hold the pre-done eyelashes into nice curls.

Figure 8:
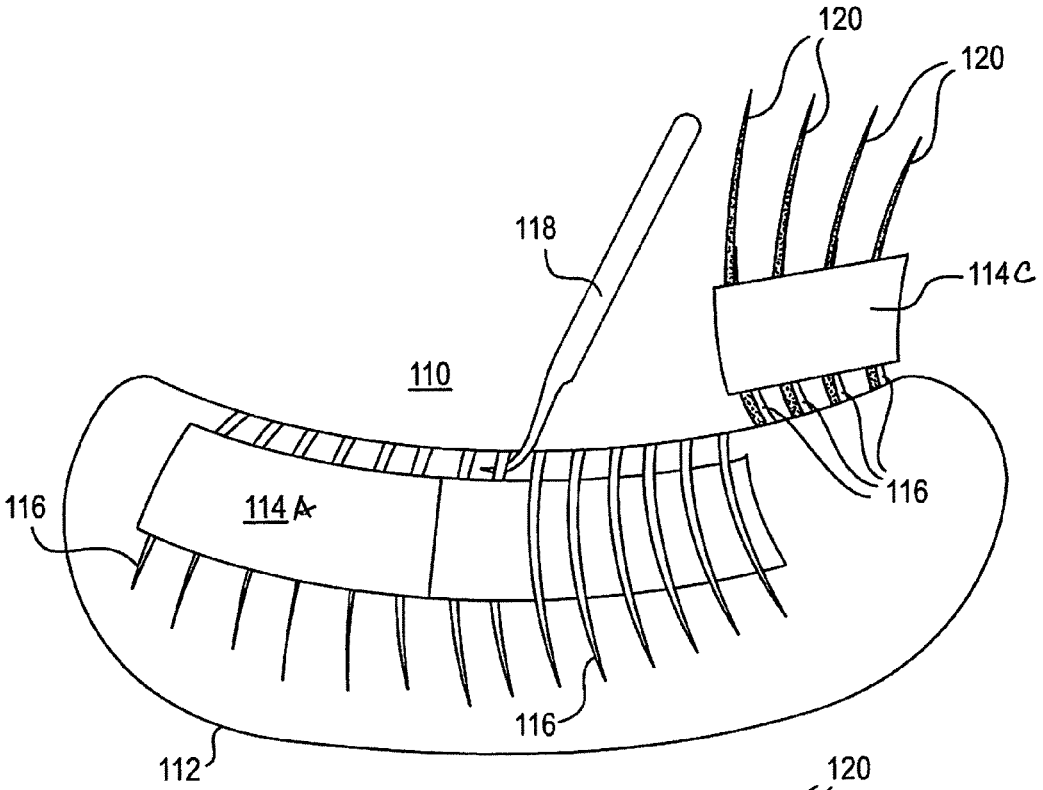
FIG. 8 is a schematic top view showing the curved tweezers used to lift-up natural eyelash strands in the second middle section.

As shown in FIG. 8, work on section two (middle section) of the eye. Use the curved tweezers 118 and pick some natural eyelashes 116 from underneath the surgical tape 114B.

Figure 9:
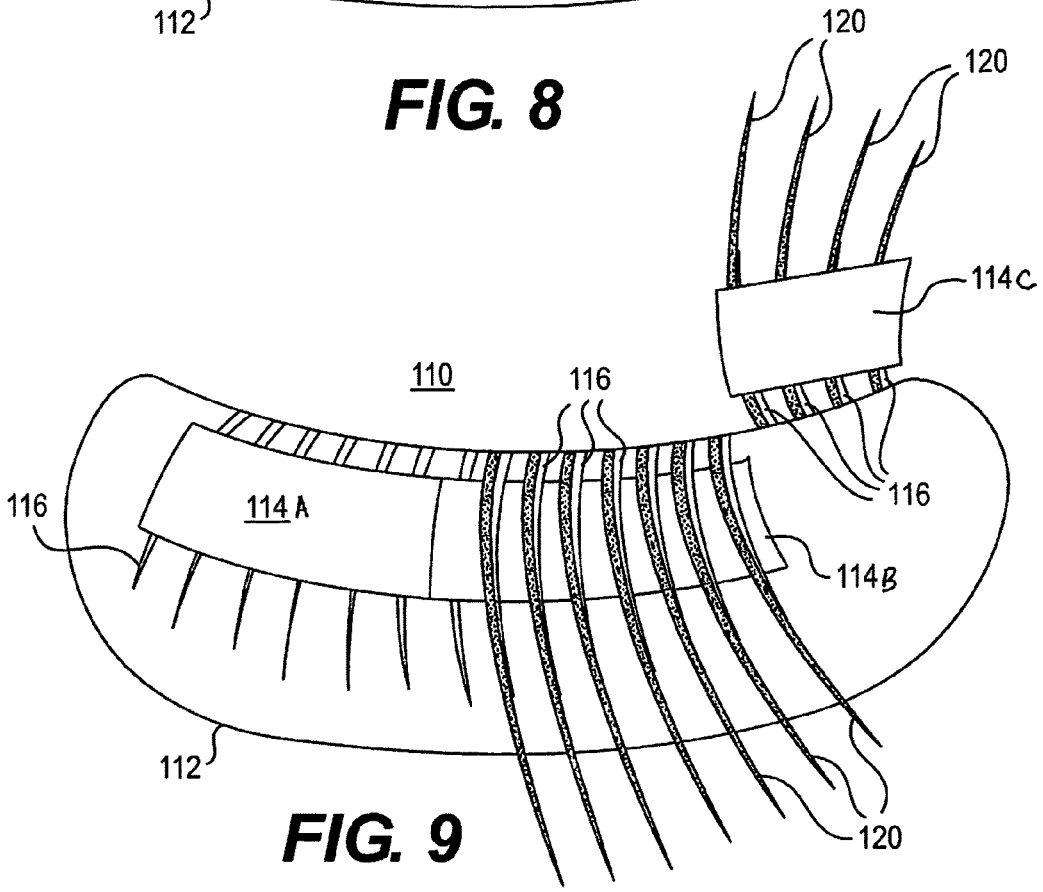
FIG. 9 is a schematic top view showing the attachment of the first, second, third, and fourth artificial eyelashes to the first, second, third, and the fourth natural eyelash strands in the second middle section.

As shown in FIG. 9, apply the single false eyelashes 120 to the natural eyelashes 116 by hitting the top of the natural eyelashes 116 or the sides of the natural eyelashes 116. At this time alternate the eyelash lengths. The single section lift-up technique customizes each of the eyelash shapes. If a client has a very high volume of eyelashes 116 in a particular section use the isolating curved tweezers procedure. Continue throughout the middle section.

Figure 10:
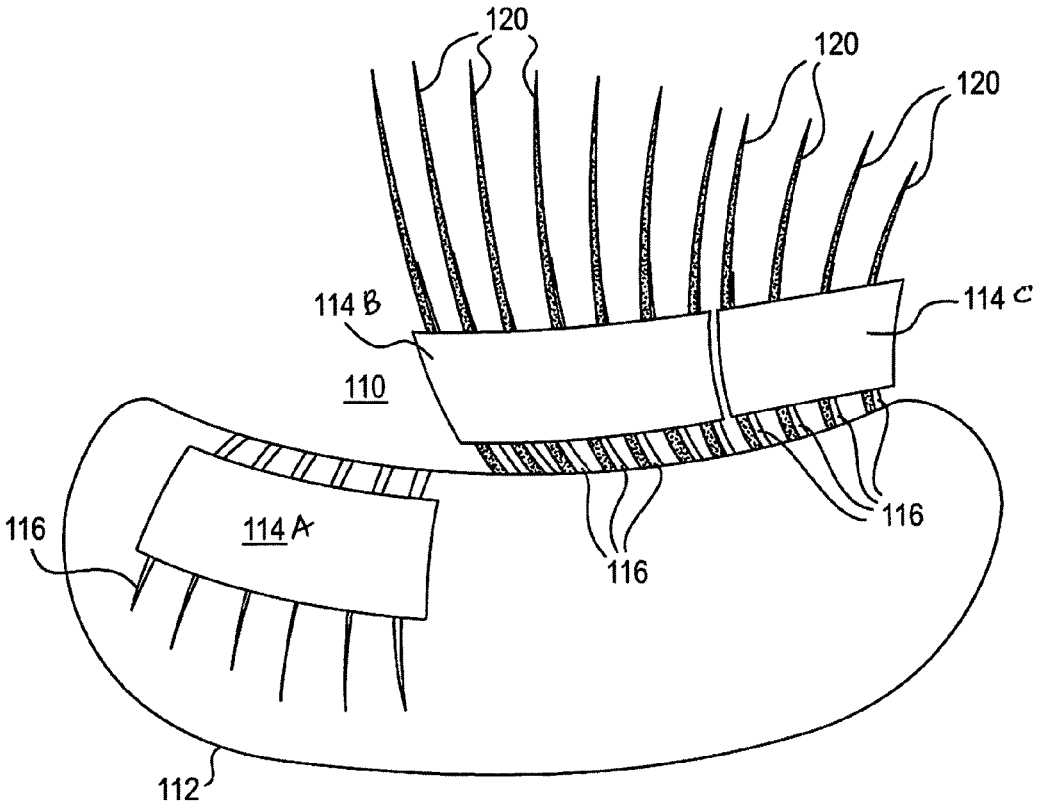
FIG. 10 is a schematic top view showing the taping up of pre-done eyelashes in the second middle section.

As shown in FIG. 10, remove the surgical tape 114B and curl the eyelashes upwards for a great curl.

Figure 11:
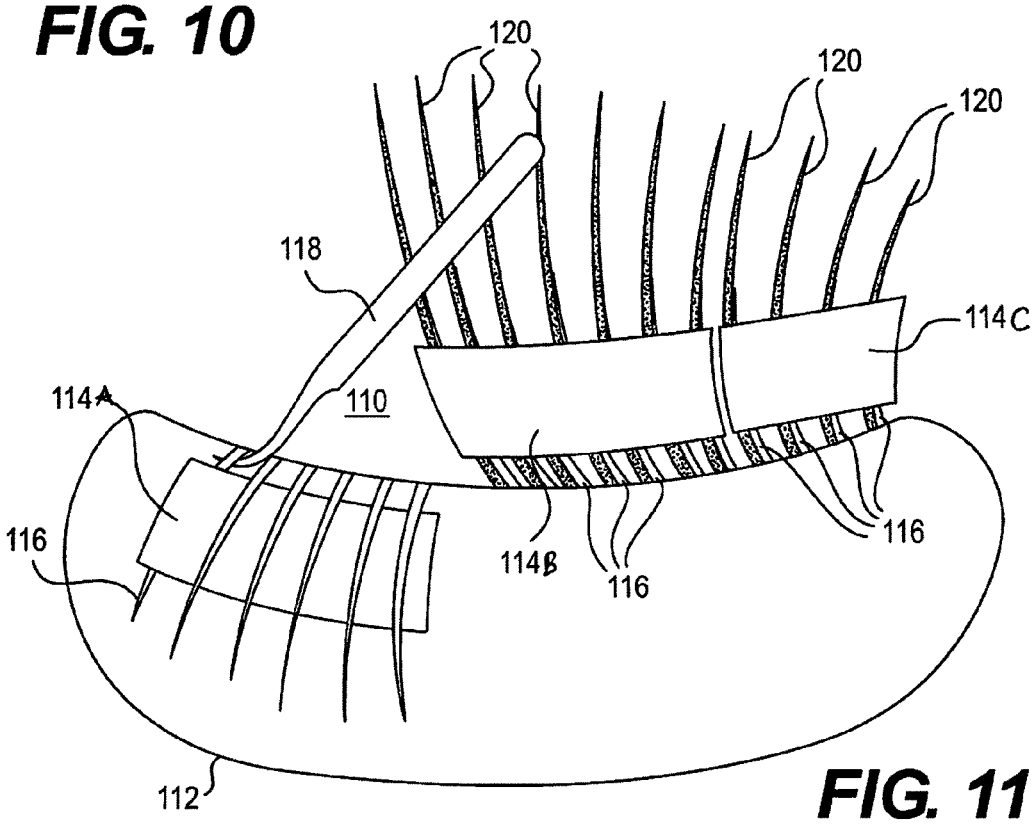
FIG. 11 is a schematic top view showing the curved tweezers to lift-up natural eyelash strands in the first outer section.
Figure 12:
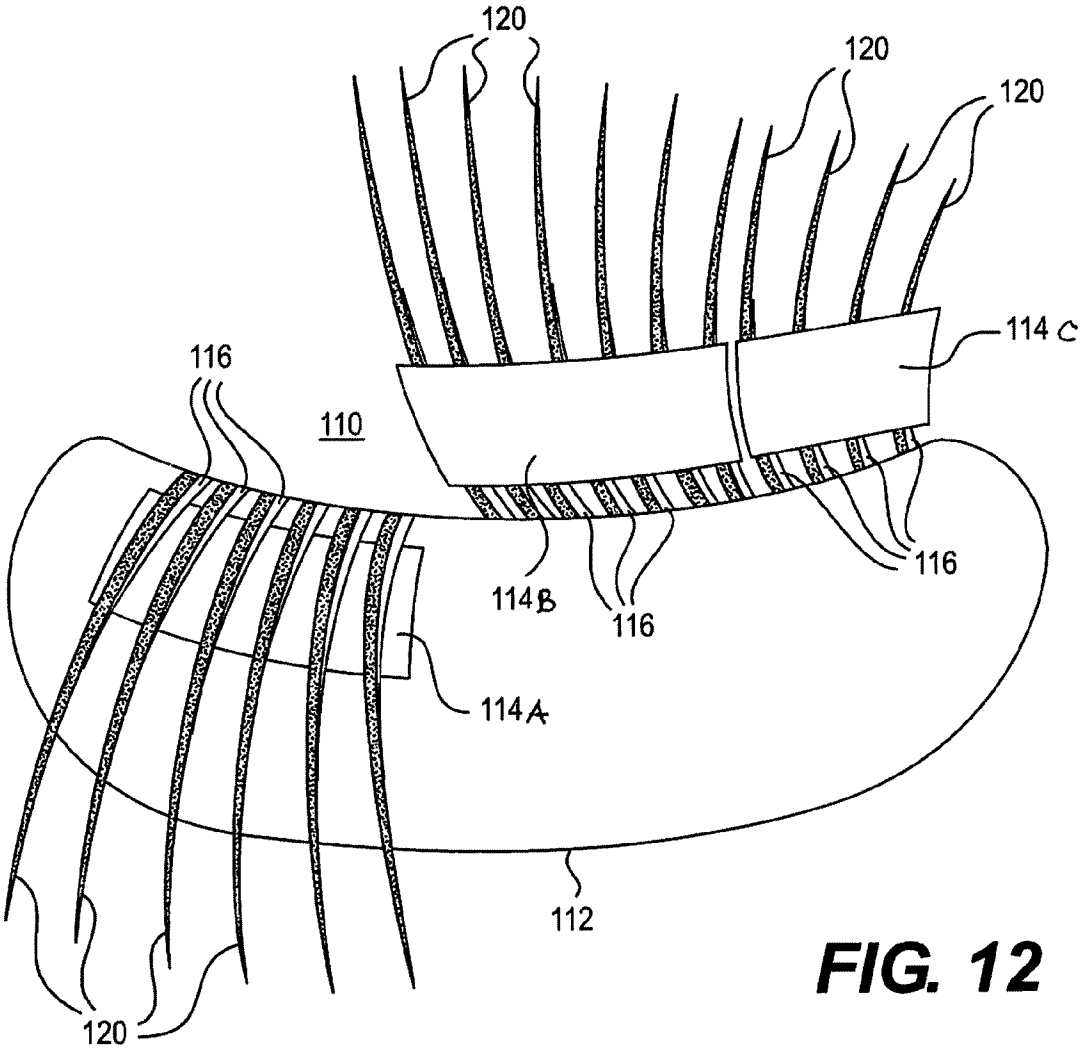
FIG. 12 is a schematic top view showing the attachment of first, second, third, and fourth artificial eyelashes to the first, second, third, and fourth lifted-up natural eyelash strands in the first outer section.

As shown in FIG. 11, work on section three (outer corner) by using the curved tweezers 118 to pick and pull out the natural eyelashes 116 from underneath the surgical tape 114A. Also comb the natural eyelashes 116 if needed. As shown in FIG. 12, apply the assigned false eyelashes 120 by attaching them to the natural eyelashes 116 with the adhesive.

Figure 13:
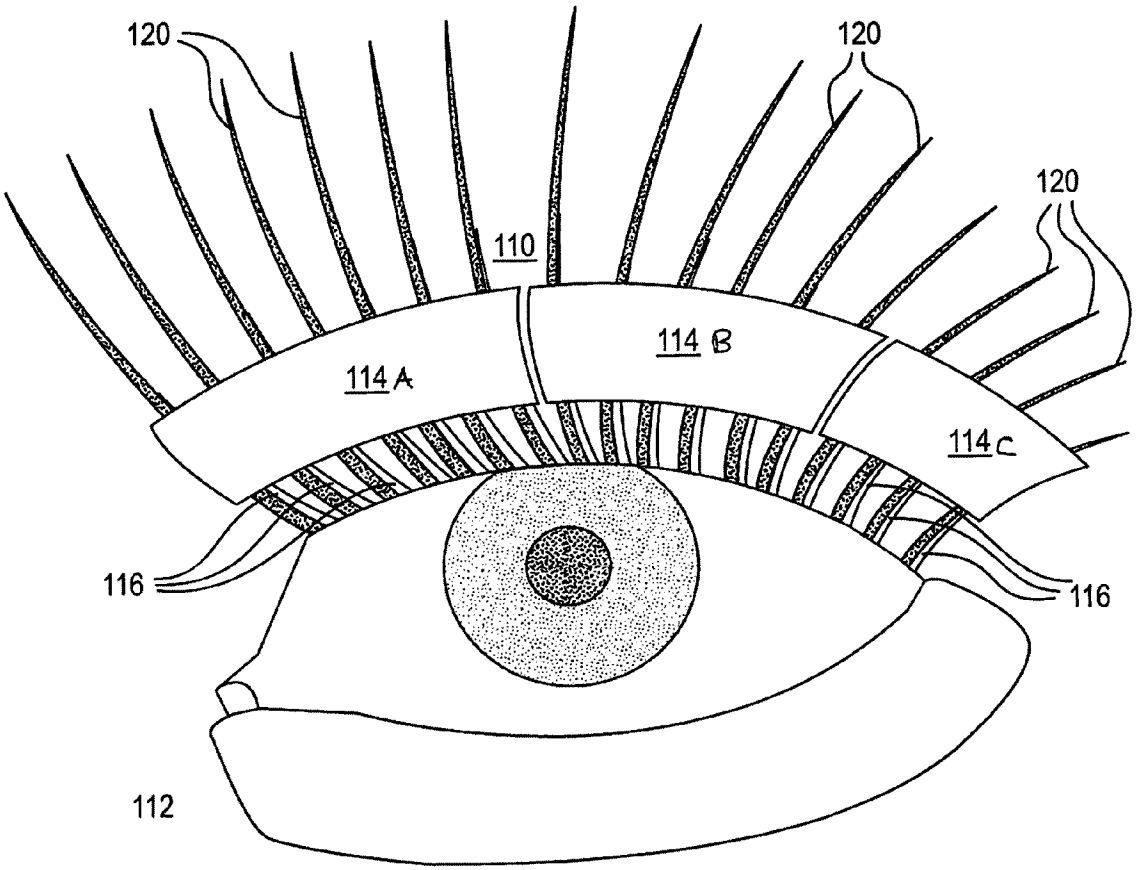
FIG. 13 is a schematic front view showing the taping up of the pre-done eyelashes in the first outer section.

As shown in FIG. 13, continue the process throughout until completion. When done with the eye, tape all the eyelashes for a greater curl. Also by taping up the eyelashes it will also give a better attachment to the natural eyelashes 116.

Make sure to take the stickiness out of the surgical tape 114 by sticking the surgical tape 114 to something else first, like a clean work surface. This will make the surgical tape 114 just sticky enough to hold the eyelashes 116 lightly, without pulling out any natural eyelashes 116.

The technique can be used with single strand false eyelashes 116, V-shaped tapered two-strand false eyelashes, or V-shaped tapered four-strand false eyelashes. Similar procedure or steps can be done for left eye of the customer.

The technique can be saved in a video in CD, DVD, film, online-posted or USB storage format for training purposes.

Touching-Up Procedure:

The natural lashes grow and shed 30 to 60 day lash cycle, the client will come back for a touch up. For the touchup: same taping procedure of taping down the lower lashes and taping the upper eyelids. With the surgical tape, we will tape the tips of the false upper lashes up to expose all the non-false attached lash to be ready to be separated and isolated. Then, a false lash is attached to the natural lash. Still working in the same order inner, middle, and outer.

It will be understood that each of the elements described above, or two or more together, may also find a useful application in other types of constructions differing from the types described above.

While the invention has been illustrated and described as embodiments of a single section lift-up technique for eyelash extensions, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A method for utilizing a single section lift-up technique for applying eyelash extensions on a customer's natural lashes comprising the steps of:

covering lower natural eyelashes of a lower eyelid with a gel pad;

putting two pieces of surgical tape onto an upper eyelid to keep the upper eyelid stationary;

dividing the upper natural eyelashes into three sections including an outer corner section, a middle section and an inner corner section and placing three pieces of surgical tape over the three sections of natural eyelashes to tape down each section individually to an exposed surface of the gel pad;

lifting up the upper natural eyelashes one at a time from under the surgical tape on the outer corner section of the upper natural eyelashes with a curved tweezers;

attaching adhesive coated false eyelashes one at a time against the upper natural lashes of the outer corner section with the curved tweezers;

upon completion of the attaching step, taping up the natural and adhered false eyelashes of the outer corner section to the upper eyelid;

lifting up the upper natural eyelashes one at a time from under the surgical tape on the middle section of the upper natural eyelashes with the curved tweezers;

attaching adhesive coated false eyelashes one at a time against the upper natural eyelashes of the middle section with the curved tweezers;

upon completion of the attaching step, taping up the natural and adhered false eyelashes of the middle section to the upper eyelid;

lifting up the upper natural eyelashes one at a time from under the surgical tape on the inner corner section of the upper natural eyelashes with the curved tweezers;

attaching adhesive coated false eyelashes one at a time against the upper natural eyelashes of the inner corner section with the curved tweezers;

and upon completion of the attaching step, taping up the natural and adhered false eyelashes of the inner corner section to the upper eyelid.

2. The method as recited in claim 1, wherein each of the false eyelashes are made from silk fibers.

3. The method as recited in claim 1, wherein each of the false eyelashes are made from faux mink fibers.

4. The method as recited in claim 1, wherein each of the false eyelashes are from between 6 mm to 16 mm in length.

5. The method as recited in claim 1, comprising the step of sizing wherein each of the false eyelashes have a diameter from 0.10 mm to 0.35 mm.

6. The method as recited in claim 1, wherein each of the false eyelashes have a different curl shape, where the curl shapes include J-shaped natural curl, a D-shaped curl which is curlier than the J-shape curl, a C-shape curl which is curlier than both the J-shaped and D-shaped curls, and a B-shaped curl which is curlier than the J-shaped, D-shaped and C-shaped curls.

7. The method as recited in claim 1, further comprising the step of making a video of all of the previous listed steps in CD, DVD, film, online-posted or USB storage format for training purposes.

* * * * *